US009205539B2

(12) United States Patent
Kundracik et al.

(10) Patent No.: US 9,205,539 B2
(45) Date of Patent: Dec. 8, 2015

(54) WRENCH

(71) Applicant: EMERSON ELECTRIC CO., St. Louis, MO (US)

(72) Inventors: Richard R. Kundracik, Elyria, OH (US); Jason J. Boggs, South Amerst, OH (US); Glen R. Chartier, Avon Lake, OH (US); Prasad Chatursingh Patil, Maharashtra (IN)

(73) Assignee: EMERSON ELECTRIC CO., St. Louis, MO (US)

( * ) Notice: Subject to any disclaimer, the term of this patent is extended or adjusted under 35 U.S.C. 154(b) by 262 days.

(21) Appl. No.: 13/908,316

(22) Filed: Jun. 3, 2013

(65) Prior Publication Data

US 2014/0290444 A1 Oct. 2, 2014

(30) Foreign Application Priority Data

Apr. 1, 2013 (IN) ..... 1263/MUM/2013

(51) Int. Cl.

| | |
|---|---|
| ***B25B 13/50*** | (2006.01) |
| ***E21B 19/16*** | (2006.01) |
| ***B25B 13/52*** | (2006.01) |

(52) U.S. Cl.

CPC ..... *B25B 13/505* (2013.01); *B25B 13/52* (2013.01); *E21B 19/161* (2013.01)

(58) Field of Classification Search

CPC .. B25B 13/505; B25B 13/52; B25B 13/5041; B25B 13/5025; E21B 19/16; E21B 19/161

See application file for complete search history.

(56) References Cited

U.S. PATENT DOCUMENTS

| | | | | |
|---|---|---|---|---|
| 379,123 | A | 3/1888 | Parmelee | |
| 590,853 | A | 9/1897 | Parmelee | |
| 608,202 | A | 8/1898 | Kleckner | |
| 626,401 | A | 6/1899 | Wiegand | |
| 648,706 | A | 5/1900 | Parmelee | |
| 701,237 | A | 5/1902 | Wight | |
| 747,612 | A | 12/1903 | Jones | |
| 791,814 | A | 6/1905 | Pitzer | |
| 807,258 | A | 12/1905 | Foggan | |
| 871,436 | A | 11/1907 | Parmelee | |
| 878,388 | A | 2/1908 | Heimann | |
| 917,440 | A | 4/1909 | Hughes | |
| 958,698 | A * | 5/1910 | Dunn | 81/90.5 |
| 1,004,792 | A | 10/1911 | Bessolo | |
| 1,072,320 | A | 9/1913 | Dunham | |
| 1,093,496 | A | 4/1914 | Stringfellow | |

(Continued)

FOREIGN PATENT DOCUMENTS

| | | |
|---|---|---|
| CN | 2116561 | 2/1992 |
| CN | 2150020 | 8/1992 |

(Continued)

OTHER PUBLICATIONS

International Search Report (ISR) and Written Opinion, PCT/US2014/031900, Aug. 22, 2014 (11 pages).

*Primary Examiner* — David B Thomas

(74) *Attorney, Agent, or Firm* — Mark E. Bandy; Rankin, Hill & Clark LLP

(57) ABSTRACT

A wrench having a collection of moveably positionable jaws which is pivotally affixed to a handle is described. The wrench can include the use of one or more regions of friction material located about an enclosed gripping region. The wrench finds particular application in drilling industries.

73 Claims, 13 Drawing Sheets

(56) References Cited

U.S. PATENT DOCUMENTS

| | | | | | |
|---|---|---|---|---|---|
| 1,128,467 | A | | 2/1915 | Lewis | |
| 1,161,777 | A | | 11/1915 | La Rock | |
| 1,177,620 | A | | 4/1916 | Hardeman | |
| 1,310,995 | A | | 7/1919 | Langford | |
| 1,334,250 | A | | 3/1920 | Langford | |
| 1,380,513 | A | | 6/1921 | Zilen et al. | |
| 1,401,964 | A | | 1/1922 | Cromwell | |
| 1,443,568 | A | * | 1/1923 | Dunn et al. | 81/90.5 |
| 1,454,016 | A | | 5/1923 | Steen | |
| 1,483,486 | A | | 2/1924 | Scott et al. | |
| 1,544,807 | A | | 7/1925 | Childs | |
| 1,548,344 | A | | 8/1925 | Bessolo | |
| 1,556,169 | A | | 10/1925 | Smith | |
| 1,584,861 | A | | 5/1926 | Jones | |
| 1,593,000 | A | | 7/1926 | Wilson | |
| 1,611,808 | A | * | 12/1926 | Bessolo | 81/90.2 |
| 1,718,719 | A | | 6/1929 | Turner | |
| 1,763,135 | A | | 6/1930 | Luther | |
| 2,047,506 | A | | 7/1936 | Hertel | |
| 2,088,148 | A | | 7/1937 | Wilson | |
| 2,209,988 | A | | 8/1940 | Matlock | |
| 2,278,439 | A | | 4/1942 | Grau et al. | |
| 2,310,246 | A | | 2/1943 | Lundeen | |
| 2,329,181 | A | | 9/1943 | Boynton | |
| 2,339,760 | A | | 1/1944 | Boynton | |
| 2,423,326 | A | | 7/1947 | Jones | |
| 2,465,695 | A | | 3/1949 | Osborne | |
| 2,517,366 | A | * | 8/1950 | Wilson | 81/186 |
| 2,557,202 | A | | 6/1951 | Gwynne et al. | |
| 2,557,342 | A | * | 6/1951 | Delbert | 81/90.7 |
| 2,637,236 | A | | 5/1953 | Vergnani et al. | |
| 2,720,128 | A | * | 10/1955 | Woolley | 81/186 |
| 2,967,446 | A | | 1/1961 | Martois | |
| 3,097,552 | A | | 7/1963 | Kelley | |
| 3,832,918 | A | | 9/1974 | Lang et al. | |
| 3,969,963 | A | | 7/1976 | Roseby | |
| 4,194,419 | A | | 3/1980 | Mitchhart et al. | |
| 4,893,528 | A | | 1/1990 | Chung Hsing | |
| 4,989,909 | A | | 2/1991 | Bouligny, Jr. et al. | |
| 5,094,132 | A | | 3/1992 | Engel | |
| 5,230,264 | A | | 7/1993 | Kindling | |
| 5,231,899 | A | | 8/1993 | Lee | |
| 5,287,777 | A | | 2/1994 | Kolodziej | |
| 5,435,214 | A | | 7/1995 | Sisson | |
| 5,452,886 | A | | 9/1995 | Cote et al. | |
| 5,535,647 | A | | 7/1996 | Donaldson | |
| 5,535,650 | A | | 7/1996 | Mcnatt | |
| 5,537,900 | A | | 7/1996 | Schaar | |
| 5,653,297 | A | | 8/1997 | Whisenhunt | |
| 5,746,097 | A | | 5/1998 | McCann | |
| 5,768,958 | A | | 6/1998 | Gamble | |
| 5,791,206 | A | | 8/1998 | Daigle et al. | |
| 5,829,327 | A | | 11/1998 | Stanton | |
| 5,865,073 | A | | 2/1999 | Wilson et al. | |
| 5,927,159 | A | | 7/1999 | Yokoyama et al. | |
| 5,941,142 | A | | 8/1999 | Janson | |
| 5,996,444 | A | | 12/1999 | Pearce et al. | |
| 6,055,888 | A | | 5/2000 | Mitchell | |
| 6,116,118 | A | | 9/2000 | Wesch, Jr. | |
| 6,131,491 | A | | 10/2000 | Hirse | |
| 6,341,543 | B1 | | 1/2002 | Hsieh | |
| 6,349,621 | B1 | | 2/2002 | Khachatoorain | |
| 6,439,064 | B1 | * | 8/2002 | Fanguy | 73/862.25 |
| 6,530,297 | B2 | | 3/2003 | McCann | |
| 6,568,301 | B2 | | 5/2003 | Huang | |
| 6,799,493 | B2 | | 10/2004 | Wang | |
| 6,938,519 | B2 | | 9/2005 | Boyd et al. | |
| 6,978,701 | B1 | | 12/2005 | Buchanan | |
| 6,988,430 | B1 | | 1/2006 | Putney et al. | |
| 7,111,529 | B2 | | 9/2006 | Pradelski | |
| 7,197,964 | B2 | | 4/2007 | Buchanan | |
| 7,275,463 | B2 | | 10/2007 | Sipos et al. | |
| 7,665,514 | B2 | | 2/2010 | Patterson | |
| 7,721,628 | B2 | * | 5/2010 | Lorger et al. | 81/90.3 |
| 7,913,589 | B2 | | 3/2011 | Chen | |
| 8,453,542 | B2 | | 6/2013 | Gouws | |
| 2004/0194967 | A1 | | 10/2004 | Jaensch | |
| 2005/0188793 | A1 | | 9/2005 | Cherry | |
| 2010/0122608 | A1 | | 5/2010 | Chen | |
| 2010/0282033 | A1 | | 11/2010 | Buchanan | |
| 2011/0138972 | A1 | | 6/2011 | Wojick | |
| 2011/0203420 | A1 | | 8/2011 | Riestra | |
| 2011/0209586 | A1 | | 9/2011 | Wojick | |
| 2011/0232427 | A1 | | 9/2011 | Streater et al. | |
| 2013/0232750 | A1 | * | 9/2013 | Pullins | 29/402.09 |

FOREIGN PATENT DOCUMENTS

| | | |
|---|---|---|
| CN | 2161425 | 5/1993 |
| CN | 2181374 | 9/1993 |
| CN | 1041180 | 1/1995 |
| CN | 2275013 | 5/1996 |
| CN | 2271949 | 9/1996 |
| CN | 2291258 | 5/1997 |
| CN | 2356809 | 1/2000 |
| CN | 2657863 | 9/2003 |
| CN | 2656087 | 10/2003 |
| CN | 2685007 | 2/2004 |
| CN | 2782307 | 1/2005 |
| CN | 2770880 | 3/2005 |
| CN | 2923201 | 5/2006 |
| CN | 201046558 | 6/2006 |
| CN | 2930983 | 7/2006 |
| CN | 201098856 | 7/2007 |
| CN | 201115940 | 11/2007 |
| CN | 201342650 | 2/2009 |
| CN | 201744941 | 12/2009 |
| CN | 201632962 | 1/2010 |
| CN | 201659522 | 4/2010 |
| CN | 201856195 | 11/2010 |
| CN | 202344440 | 9/2011 |
| CN | 202377960 | 12/2011 |
| WO | 2009093763 | 7/2009 |
| WO | 2011089297 | 7/2011 |

* cited by examiner

WRENCH

FIELD

The present subject matter relates to tools such as wrenches and related systems for engaging cylindrical components typically used in drilling operations.

BACKGROUND

Core barrel assemblies are used in a variety of drilling industries such as in the fields of ore mining, petroleum drilling, water well drilling, and geotechnical drilling and surveying industries. Core barrel assemblies are used to obtain a core sample at an end of a drilling passage. Typical core barrel assemblies include an inner tube assembly and an outer tube assembly. The outer tube assembly contains the inner tube assembly and provides engagement to other drilling components such as a drill string or collection of drill rods.

During a core sampling operation, after collecting a core sample from a bottom region of a drill hole, the inner tube assembly contains the core sample. The inner tube and core sample are retrieved from the bottom of the drill hole using a wire line that is pulled through the drill rods.

Depending upon the configuration of the core barrel assembly and/or the inner tube, a variety of components may be engaged with the inner tube such as a core barrel head and a core lifter. These components and potentially others are engaged with the inner tube by threaded connections. These threaded connections must be disengaged from one another in order to remove the core sample.

Engaging or disengaging threaded components with an inner tube such as in accessing a core sample contained in the inner tube, can be problematic. Relatively high levels of torque may be required. Dirt and debris may cover the components and/or threads. Exposure and contact with core drilling fluids may pose additional problems. Bentonite clay drilling fluids contain clay particles and can be slightly corrosive. Drilling fluids may also include polymer filtration control and stabilizers, lubricants such as drill rod grease, and cutting oils. The presence of these agents on the inner tube and/or threaded regions, can further impede engagement or disengagement operations particularly in situations when the outer surface of the tube contains lubricious agents.

Core barrel assemblies are typically machined assemblies with relatively high tolerances. Thus, it is important to not damage the outer surface of the inner tube such as by using a traditional pipe wrench. Typical pipe wrenches have pipe engaging faces with teeth that can form "digs," burrs, or other surface defects on the outer surface of the inner tube. In addition, if excessive force is applied by a pipe wrench, the inner tube can be deformed.

In view of these and other reasons, the drilling industry typically uses specialized wrenches with a carbide coating to grip core barrel assemblies and particularly inner tubes. Although satisfactory in certain aspects, a need remains for an improved tool for securely engaging core barrel components such as an inner tube, without damaging the component.

SUMMARY

The difficulties and drawbacks associated with previously known practices and tools are addressed in the present wrench and related methods of use.

In one aspect, the present subject matter provides a wrench comprising a handle defining a first end and a second end opposite from the first end. The wrench also comprises a first jaw having a proximal end and a distal end. The first jaw defines an interior face. The proximal end of the first jaw is pivotally attached to the first end of the handle. The wrench also comprises a second jaw having a proximal end and a distal end. The second jaw defines an interior face. The proximal end of the second jaw is pivotally attached to the distal end of the first jaw at a first joint assembly. The wrench also comprises a third jaw having a proximal end and a distal end. The third jaw defines an interior face. The proximal end of the third jaw is pivotally attached to the distal end of the second jaw at a second joint assembly. The distal end of the third jaw is releasably engageable with the first end of the handle. The first, second, and third jaws are positionable between (i) a closed position in which the distal end of the third jaw is engaged with the first end of the handle and the interior faces of the first, second, and third jaws define an enclosed gripping region defining a closure span, and (ii) a fully opened position in which the distal end of the third jaw is spaced from the first end of the handle to thereby enable radial access to the gripping region. When the wrench is in a fully opened position at least one of the following occurs: (a) a maximum distance between the distal end of the third jaw and the first end of the handle is less than 300% of the closure span; (b) a maximum distance between opposite interior faces of the first jaw and the second jaw is less than 300% of the closure span; and (c) a maximum distance between opposite interior faces of the second jaw and the third jaw is less than 300% of the closure span.

In another aspect, the present subject matter provides a wrench comprising a handle defining a first end and a second end, and a plurality of hingedly connected jaw members. The plurality of jaw members include a primary jaw member pivotally attached to the first end of the handle and a terminal jaw member engageable with the handle. Each of the plurality of jaw members defines an interior face. The wrench also comprises a fibrous friction material disposed on at least one of the interior faces of the plurality of jaw members.

And, in yet another aspect, the present subject matter also provides a system comprising a cylindrical member having a diameter and a maximum allowable load limit associated with the cylindrical member, and a wrench including a handle defining a first end and a second end, and a plurality of hingedly connected jaw members. The plurality of jaw members includes a primary jaw member pivotally attached to the first end of the handle and a terminal jaw member engageable with the handle. Each of the plurality of jaw members defines an interior face. The wrench also includes a friction material disposed on at least one of the interior faces of the plurality of jaw members. The wrench is positionable between a fully opened position and a closed position. The closed position results in the plurality of jaws defining an enclosed gripping region and a closure span extending between faces of friction material on opposing regions of the plurality of jaws. The wrench is configured such that the closure span is sized relative to the diameter of the cylindrical member so that upon positioning the cylindrical member within the gripping region and positioning the wrench to the closed position, the loads applied to the cylindrical member from the wrench are less than the maximum allowable load limit associated with the cylindrical member.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
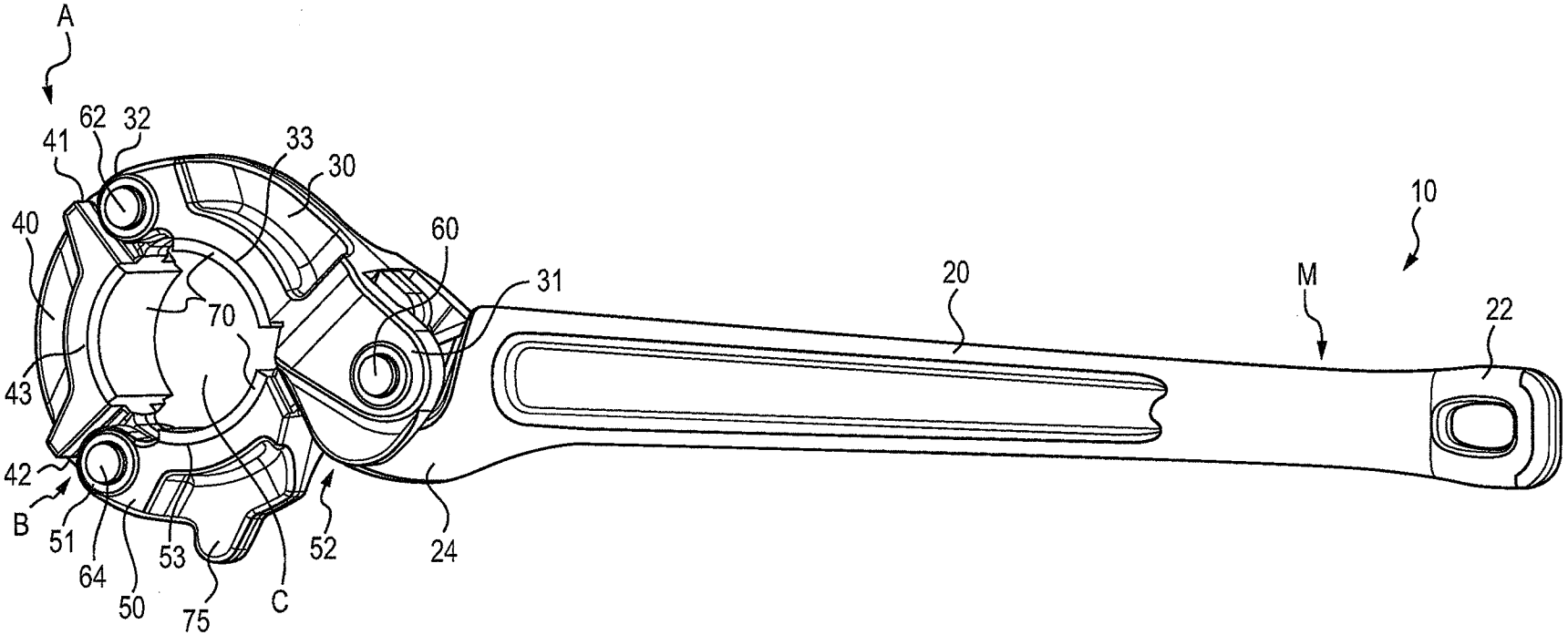
FIG. 1 is a perspective view of a wrench in accordance with the present subject matter.

The present subject matter provides wrenches which are uniquely adapted for use in engaging and disengaging components associated with core barrel assemblies, and particularly for inner tubes of core barrel assemblies. Although the wrenches of the present subject matter are described herein as for use with inner tubes of core barrel assemblies, it will be appreciated that the present subject matter wrenches are applicable to other uses and industries besides the drilling industry. Generally, the present subject matter wrenches comprise a handle and a plurality of hingedly or pivotally connected jaw members. The collection of jaw members are positionable between an open position in which an inner tube or other component can be positioned within a gripping region defined by the jaws; and a closed position in which the jaws engage the inner tube disposed in the gripping region.

In certain versions of the present subject matter, the wrenches also include particular friction materials located along inner faces of the jaws which promote friction engagement with an inner tube or other component positioned or located in the gripping region.

In certain versions of the present subject matter, the wrenches also include one or more biasing members such as springs to bias the jaws or plurality of jaws to particular positions. In particular, certain versions of the wrenches include biasing members which bias or urge the jaws to a closed position. However, the present subject matter also includes configurations in which the jaws are biased to an open position.

In certain versions of the present subject matter, the wrenches also include one or more provisions which facilitate grasping one or more jaw members. For example, a projection or outwardly extending member can be provided on one or more of the jaws which can be grasped by a user.

In certain versions of the present subject matter, the wrenches also include provisions that limit articulation, angular position, and/or movement of one or more jaws. These provisions can be incorporated in the wrenches to limit the extent of opening of the jaws.

In certain versions of the present subject matter, the wrenches also include provisions that impart a particular contact pattern to an inner tube or other cylindrical component located in the gripping region during engagement of the jaws to the tube. As loads are increasingly applied to the inner tube, the particular contact pattern increases contact surface area and promotes a more uniform application of friction and force transfer between the wrench and the inner tube.

In certain versions of the present subject matter, the wrenches also include provisions that utilize a particular engagement configuration and a contact angle between a jaw and a handle or associated component of the wrench. The engagement configuration facilitates transfer of forces between the components during use of the wrench.

In certain versions of the present subject matter, the wrenches also utilize a stop feature which prevents transfer of excessive levels of force to an inner tube during use of the wrench.

In still other versions of the present subject matter, the wrenches also include a self-locking feature in which closing of the plurality of jaws about an inner tube is further promoted during use of the wrench.

And in certain versions of the subject matter, the wrenches include covers or guards to limit access to a region at which engagement between a jaw and a handle occurs, during use of the wrench.

Again, it will be understood that in no way are the wrenches of the present subject matter limited to use with inner tubes of core barrel assemblies. Instead, it is contemplated that the wrenches could be used in a variety of other fields and applications. Furthermore, it will be appreciated that the present subject matter includes wrenches with one or more features or aspects and combinations of these features or aspects. Details of the various features and aspects of the wrenches of the present subject matter are as follows.

Figure 2:
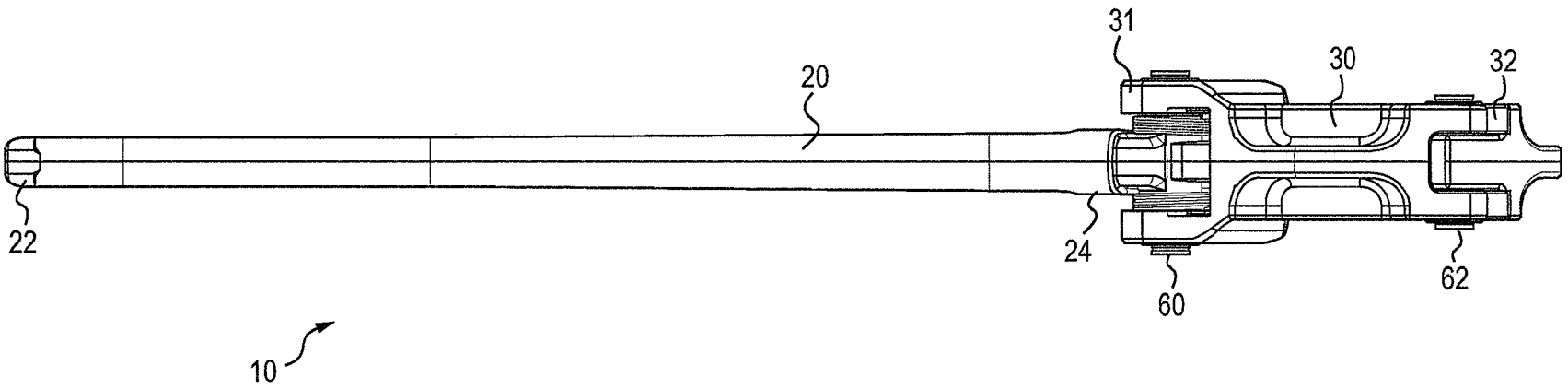
FIG. 2 is a top planar view of the wrench depicted in FIG. 1.

FIG. 1 illustrates a perspective view of a wrench 10 in accordance with the present subject matter. FIG. 2 is a top planar view of the wrench 10 shown in FIG. 1. The wrench 10 comprises a handle 20 having a proximal end 22 and a distal end generally shown as 24. The wrench 10 also comprises a plurality of jaw members or jaw portions. In the version depicted in FIG. 1, the wrench 10 comprises a first or primary jaw 30, a second jaw 40, and a third or terminal jaw 50. It will be understood that the present subject matter wrenches can utilize a lesser number of jaws such as two, or a greater number of jaws such as four, five, six, or more.

As described in greater detail herein, the wrench 10 is used by positioning an inner tube (not shown) within a gripping region C defined by the plurality of jaws. As a force is applied to the handle 20 such as shown for example in FIG. 1 by arrow M, the gripping region C constricts about, contacts, and engages the inner tube. Details as to each of these aspects and other features are provided herein. With further reference to FIG. 1, the first jaw 30 defines a proximal end 31 and a distal end 32. The second jaw defines a proximal end 41 and a distal end 42. The third jaw 50 defines a proximal end 51 and a distal end 52. Each jaw member also defines an inwardly directed face. Thus, the first jaw member 30 defines an interior face 33, the second jaw member 40 defines an interior face 43, and the third jaw member 50 defines an interior face 53. The proximal end 31 of the first jaw 30 is pivotally attached to the distal end 24 of the handle 20. Although various assemblies and configurations can be utilized, a pivot pin 60 extending through aligned apertures defined in the first jaw 30 and the handle 20 is depicted in the version of FIG. 1. The distal end 32 of the first jaw 30 is pivotally attached to the proximal end 41 of the second jaw 40 at a first joint assembly generally referenced as joint A in FIG. 1. In the version of FIG. 1, a pivot pin 62 extends through aligned apertures defined in the first jaw 30 and the second jaw 40. The distal end 42 of the second jaw 40 is pivotally attached to the proximal end 51 of the third jaw 50 at a second joint assembly generally referenced as joint B in FIG. 1. In the version shown in FIG. 1, a pivot pin 64 extends through aligned apertures defined in the second jaw 40 and the third jaw 50. One or more snap rings or retaining components can be used in association with the pivot pins 60, 62, and/or 64. Additional engagement provisions are provided between the third jaw 50 and the handle 20 and particularly at the distal end 52 of the third jaw 50 and the distal end 24, or proximate the distal end 24, of the handle 20. These engagement provisions are described in greater detail herein.

Figure 3:
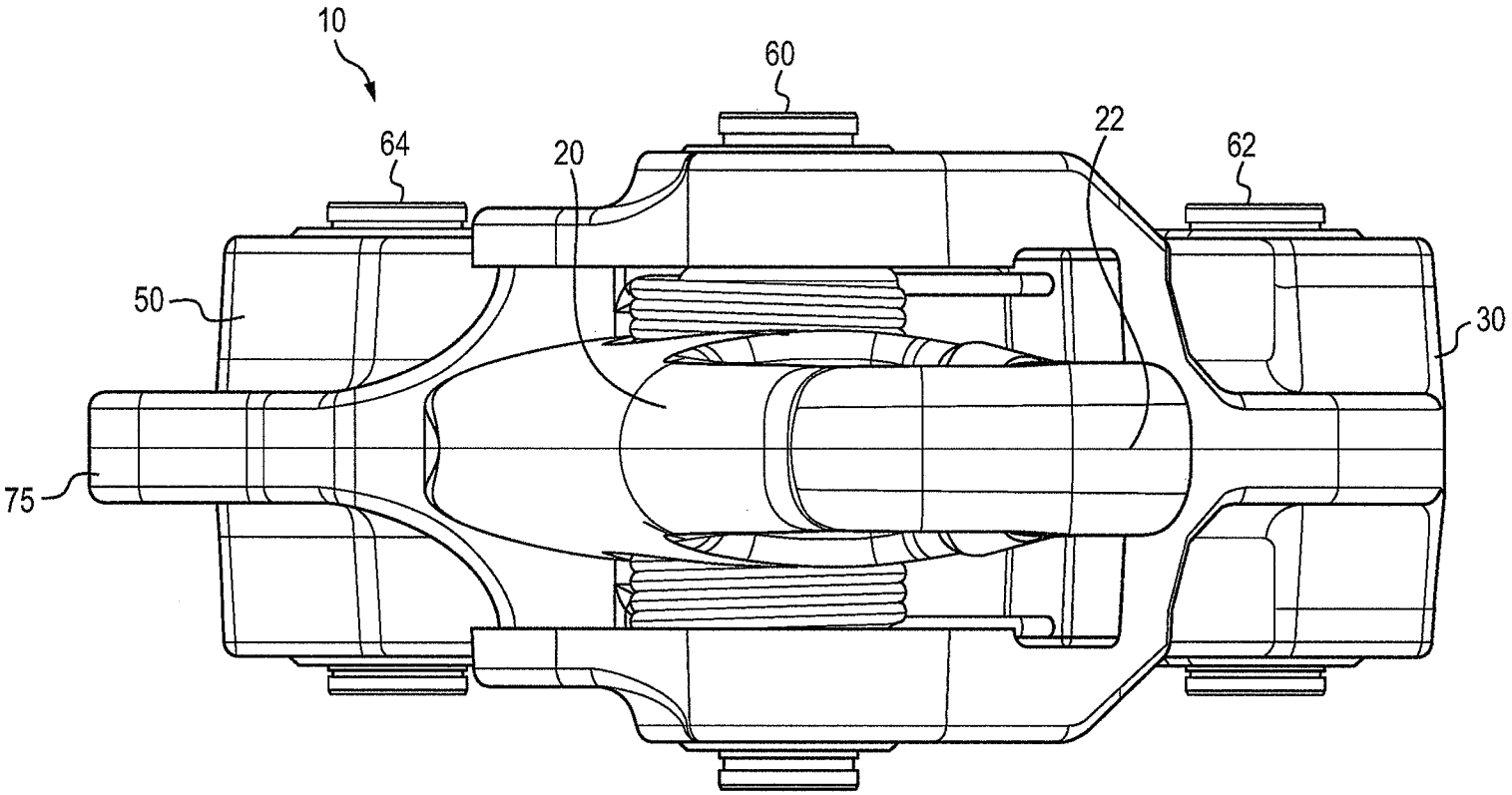
FIG. 3 is an end view of the wrench of FIG. 1.
Figure 4:
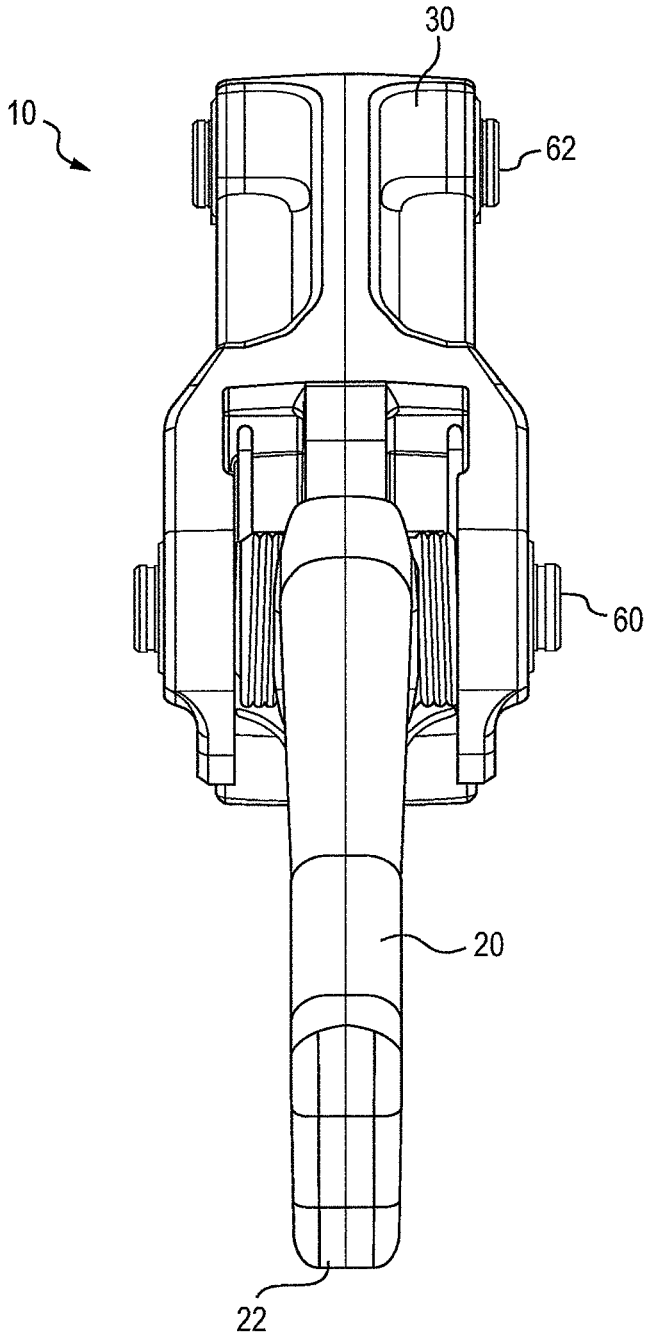
FIG. 4 is another end view of the wrench of FIG. 1.

FIGS. 3 and 4 illustrate end views of the wrench 10 depicted in FIG. 1. FIGS. 3 and 4 illustrate additional aspects of the wrench.

The wrench 10 may also include one or more regions of a friction material to promote engagement with an inner tube or other component. In the version shown in FIG. 1, the wrench 10 comprises friction material 70 disposed on each of the interior faces 33, 43, and 53 of the first jaw 30, second jaw 40, and third jaw 50, respectively. The friction material can be provided in a variety of different forms and arrangements. Generally, the friction material is in the form of a layer or region disposed on at least a portion of an interior face of a jaw. In certain versions of the present subject matter, the friction material includes one or more fibrous materials such as populations of one or more fiber types. The fibers may be in an organized arrangement such as in a woven collection, or may be nonwoven. In certain versions, the friction material is compressible as described in greater detail herein. For versions in which the friction material includes fibers, the fibers are typically metallic fibers, polymeric fibers, glass fibers, or combinations thereof. In particular versions, the friction material can be in the form of glass fibers dispersed in a polymeric matrix. A wide array of metallic fibers can be used such as for example, but not limited to, steel, brass, magnesium, and combinations thereof. Nonlimiting examples of polymeric fibers include polyamide and particularly poly (paraphenylene terephthalamide), which is also known as KEVLAR®. Combinations of metallic agents, polymeric components, and other materials can be used in various proportions and arrangements for the friction material. In many versions of the present subject matter, the friction material is free of asbestos.

As previously noted, in certain versions of the present subject matter, the friction material is compressible. This aspect can be quantified by reference to a typical range of elastic modulus values for the friction material. Thus, in certain versions, the friction material exhibits an elastic modulus within a range of from 15 ksi to 1,500 ksi.

The friction material can be carried or secured to one or more removable members such as carrier elements that in turn are engageable along the interior faces of the jaws. It is also contemplated that the friction material can be directly attached to the interior faces of the jaws. A wide array of engagement techniques and/or provisions can be used to attach or affix the friction material to carrier elements and/or to the jaws. For example, mechanical engagement can be used such as rivots, threaded fasteners, pins, screws, or other components. The friction material can be attached or affixed to carrier elements and/or to the jaws by sintering techniques to metallurgically bond the friction material to its underlying substrate. The use of adhesives is also contemplated to adhesively bond friction materials to carrier elements and/or to the jaws. The friction material can also be applied or otherwise formed upon carrier elements or the jaws by coating or spraying techniques.

In certain versions of the present subject matter, the outer exposed face of the friction material can be provided or formed to exhibit a collection of recesses or passages that extend across at least a portion of the friction material face. Such a configuration may be beneficial in instances when debris and particularly a liquid film is disposed on an outer surface of the inner tube or other component. As the face of the friction material contacts the inner tube, the debris and/or liquid film are urged toward and displaced within the recesses or passages defined in the face of the friction material, thereby promoting intimate contact between the friction material and the surface of the inner tube. Thus, in certain versions of the wrench, the faces of the friction material have a collection of recesses extending along at least a portion of the face. The collection of recesses have a size and/or configuration sufficient to receive liquid and/or debris from the outer surface of the inner tube.

The wrenches of the present subject matter may also comprise one or more biasing members that urge one or more jaws to a particular position relative to the handle and/or to other jaws. In certain versions, a biasing member such as a double torsion spring is positioned between the first jaw 30 and the distal end 24 of the handle 20. For example, the biasing member can be disposed about the pivot pin 60 and can be configured to bias the jaw 30 (and jaws 40 and 50 attached thereto) to a particular position such as an open position or a closed position. Many of the wrenches of the present subject matter are configured such that the plurality of jaws, e.g., jaws 30, 40, and 50, are biased to a closed position. A double torsion spring or other biasing member can be used and positioned about the pivot pin 60 to provide such action.

Figure 14:
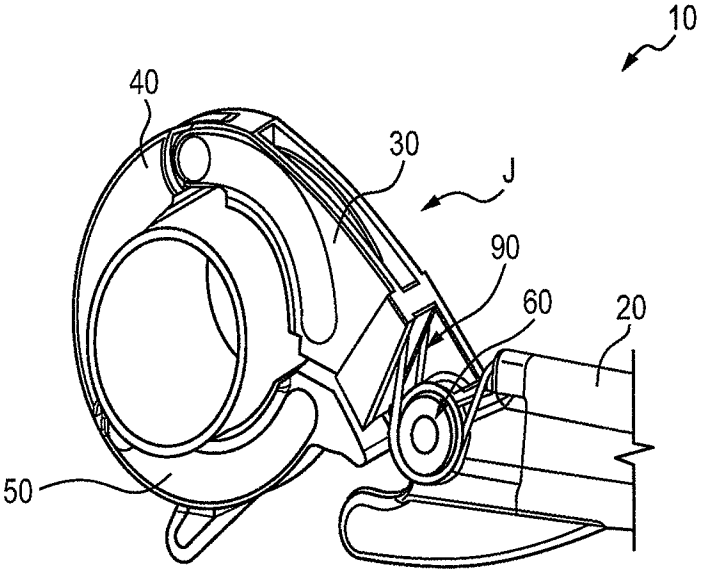
FIG. 14 is a view of a plurality of jaws and a biasing member used in a wrench in accordance with the present subject matter.

FIG. 14 illustrates provision of a biasing member 90 between the primary jaw, e.g., the jaw 30, and the handle 20. In the particular version of the wrench depicted in FIG. 14, the biasing member 90 is provided in the form of a double torsional spring. The spring can be positioned about the pivot pin 60. In a particular version of the present subject matter, the spring is configured to urge the primary jaw 30 about the pin 60 toward a closed position, e.g., in the direction of arrow J. It will be understood that the present subject matter includes variations of the particular embodiment depicted in FIG. 14.

Biasing the plurality of jaws to a closed position can be useful when using the wrench. This action tends to simulate a ratcheting action so that a user can readily apply torque to an inner tube through a sweep or path of angular displacement of the wrench handle, and then reverse motion of the wrench without excessive opening of the jaws. That is, during reversing of the wrench, the plurality of jaws remain closely positioned but slide about the inner tube due to the biasing action of the spring or other member urging the jaws toward a closed position.

The present subject matter also includes the use of biasing members provided between adjacent second and third jaws such as at Joint A and/or Joint B. Such joint biasing provisions can be utilized independently of, or in conjunction with, the biasing provisions between the first jaw and the handle.

In certain versions of the wrenches one or more projections or outwardly extending members such as "finger hooks" can be provided on one or more jaws. An example of a finger hook is shown in FIG. 1 as 75. It will be understood that the present subject matter includes finger hooks or like members on any of the jaws and in a variety of other shapes, configurations, and orientations besides the finger hook 75 depicted in FIG. 1. For example, one or more finger hooks could be provided on the second jaw 40 and/or the first jaw 30 instead of, or in addition to, the third jaw 50. Furthermore, instead of extending radially outward from a jaw, the finger hooks could extend laterally alongside a jaw. A wide array of configurations are contemplated for the finger hooks.

Figure 5:
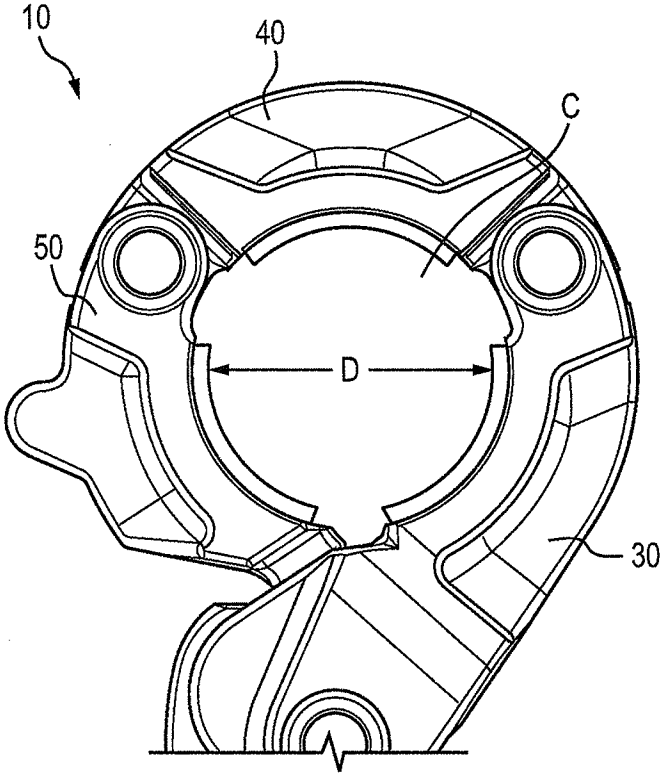
FIG. 5 illustrates the wrench of FIG. 1 in a closed position.
Figure 6:
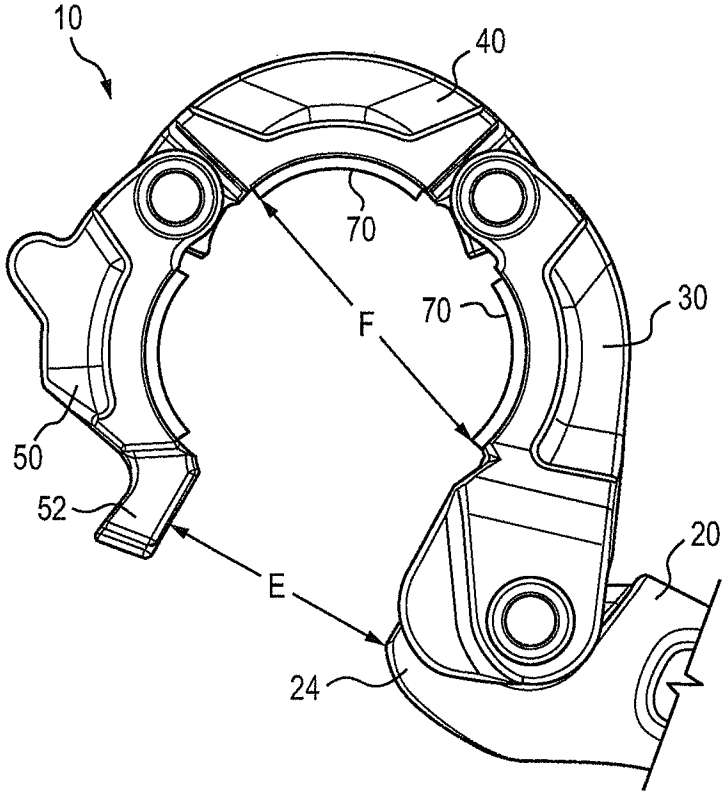
FIG. 6 illustrates the wrench of FIG. 1 in a fully opened position.

The wrenches of the present subject matter may also include a limited articulation feature that limits the extent of opening of the wrench. This feature may be beneficial when using the wrench so that during initial placement or orientation of the wrench such as about an inner tube for example, the plurality of jaws retain a particular arrangement rather than move uncontrollably or unrestrained to other positions such as toward the handle. Keeping the plurality of jaws in a position nearer their closed position increases operating and use efficiency of the wrench. FIG. 5 illustrates the wrench 10 in a closed position and the resulting gripping region C defined between the jaws 30, 40, and 50. FIG. 6 illustrates the wrench 10 in a fully opened position and the limited articulation feature in which the maximum distance between the handle 20, e.g., the distal end 24 of the handle 20, and the third jaw 50, e.g., the distal end 52 of the jaw 50, is limited.

The fully opened position enables radial access to the gripping region by an inner tube or other component to be engaged therein. Specifically, the extent of limited travel between the distal end 52 of the jaw 50 and the distal end 24 of the handle 20, can be expressed with reference to a maximum span or distance between opposing faces of friction material 70 when the wrench is in a closed position. That maximum span when the wrench is in a closed position is depicted in FIG. 5 as closure span D. The maximum distance between the distal end of the third jaw 50 and the handle 20 when the wrench is fully opened is shown in FIG. 6 as span E. In accordance with the limited articulation feature the span E can be expressed as a percentage of closure span D. Thus, in certain versions of the present subject matter, the span E is less than 300% of span D, more particularly less than 250% of span D, more particularly less than 200% of span D, and in certain applications, less than 150% of span D. In the particular version of the wrench depicted in the referenced figures, span E is equal to about 111% of the closure span D.

In another aspect of the present subject matter the limited articulation feature of the jaws can also be expressed with reference to a maximum distance measured between opposite faces of friction material 70 of the first jaw 30 and the second jaw 40 when the wrench is in a fully opened position. That maximum distance is shown in FIG. 6 as span F. In certain versions of the subject matter, the span F is less than 300% of span D, more particularly less than 250% of span D, more particularly less than 200% of span D, and in certain embodiments less than 150% of span D. In the particular version of the wrench shown in the referenced figures, span F is equal to about 142% of the closure span D.

Figure 7:
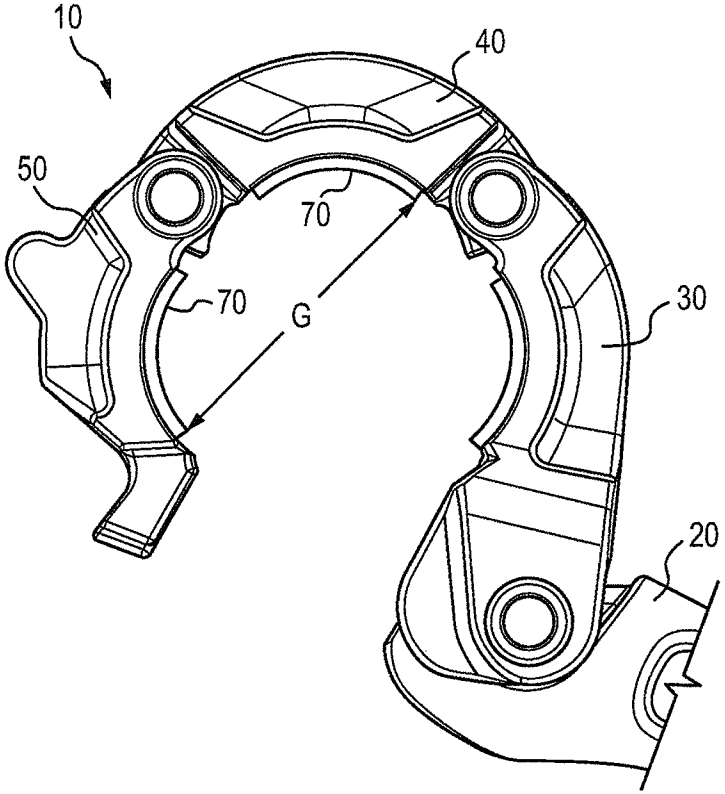
FIG. 7 also illustrates the wrench of FIG. 1 in a fully opened position.

In another aspect of the present subject matter, the limited articulation feature of the jaws can also be expressed with reference to a maximum distance measured between opposite faces of friction material 70 of the second jaw 40 and the third jaw 50 when the wrench is in a fully opened position. That maximum distance is shown in FIG. 7 as span G. In certain versions of the subject matter, the span G is less than 300% of span D, more particularly less than 250% of span D, more particularly less than 200% of span D, and in certain versions less than 150% of span D. In the particular version of the wrench shown in the referenced figures, span G is equal to about 142% of the closure span D.

Wrenches which embody the limited articulation feature may exhibit one or more of these characteristics described in association with the closure span D and spans E, F, and G. Thus, more specifically, such wrenches may exhibit at least one or more of the following: (a) a maximum distance between the distal end of the third jaw and the first end of the handle is less than 300% of the closure span, (b) a maximum distance between opposite interior faces of the first jaw and the second jaw is less than 300% of the closure span, and (c) a maximum distance between opposite interior faces of the second jaw and the third jaw is less than 300% of the closure span.

In certain versions of the wrenches, the limited articulation feature may be expressed by specifying a maximum angular displacement for two adjacent jaws. In particular embodiments, the maximum angular displacement is about 180°. Such a position is depicted in FIG. 6 between the first jaw 30 and the second jaw 40; and in FIG. 7 between the second jaw 40 and the third jaw 50.

Figure 13:
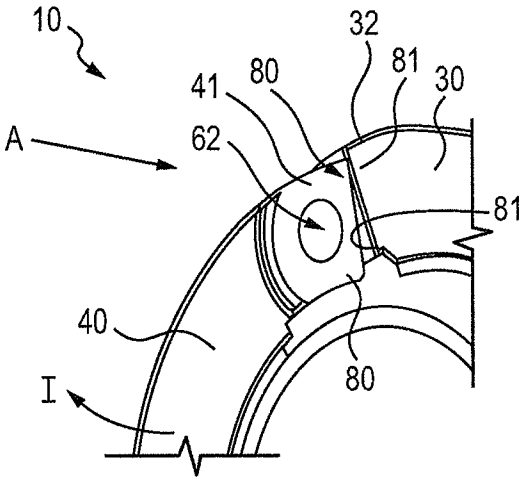
FIG. 13 is a detailed view of a joint between two adjacent jaws of a wrench in accordance with the present subject matter.

FIG. 13 illustrates a configuration that could be provided between adjacent jaws, such as for example at joint A between first and second jaws 30 and 40, to limit articulation or angular extension between those jaws. Specifically, FIG. 13 illustrates the second jaw 40 having one or more outwardly extending shoulders 80 that extend from the proximal end 41 of the jaw 40. The first jaw 30 includes one or more stop surfaces 81 at the distal end 32 of the jaw 30 that are located relatively close and in facing engagement with the shoulder(s) 80 of the second jaw 40. Thus, referring to FIG. 13 it can be seen that upon angular extension of the second jaw 40 relative to the first jaw 30 such as in the direction of arrow I, the shoulder 80 of the second jaw 40 will contact the stop face 81 of the first jaw 30 and preclude or limit any further angular extension. The present subject matter includes the use of a wide array of assemblies and structural arrangements to achieve the limited articulation aspects described herein. Thus, it will be appreciated that the present subject is not limited to any particular assembly as illustrated and/or described herein.

Figure 8:
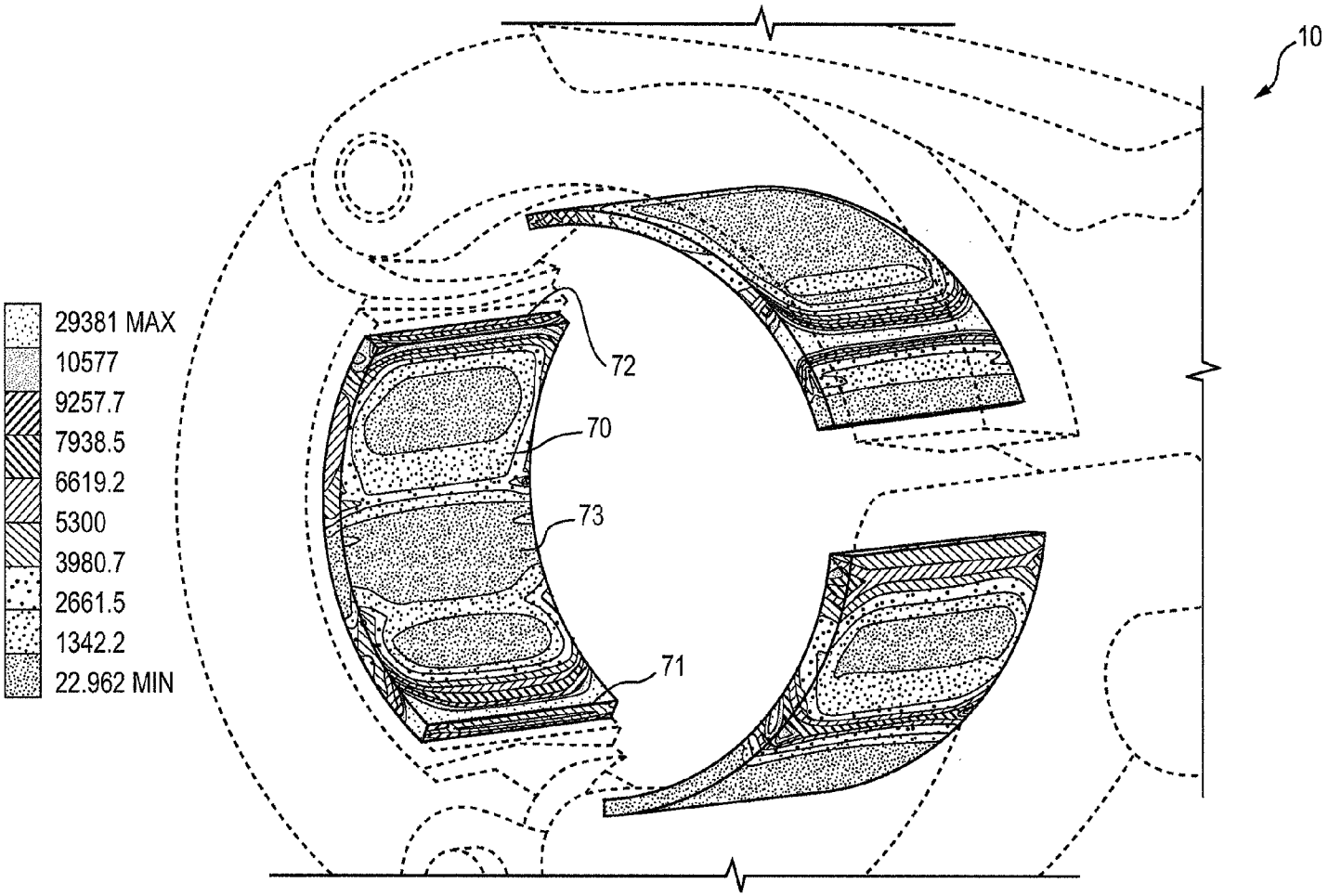
FIG. 8 illustrates contact pressures along regions of friction material during an early phase of load application and engagement with an inner tube or other component.

As previously noted, in certain versions of the present subject matter the friction material is provided in a particular configuration and/or orientation. During initial contact with an outer surface of an inner tube or other cylindrical component, the friction material is configured and/or oriented such that one or more edges or peripheral regions of the friction material contact the inner tube. In certain versions of the wrench, contact between the friction material and the inner tube initially occurs and/or during early phases of torque transfer from the wrench to the inner tube along two opposite edges of each region of friction material. This is shown in FIG. 8 in which a first edge 71 and a second opposite edge 72 of the friction material 70 experience greater stresses during loading than region(s) of the friction material 70 between those edges such as an interior face region 73. It will be appreciated that the noted first and second edges of the friction material generally extend in a direction parallel to a longitudinal axis of an inner tube when the wrench is used on the inner tube.

Figure 9:
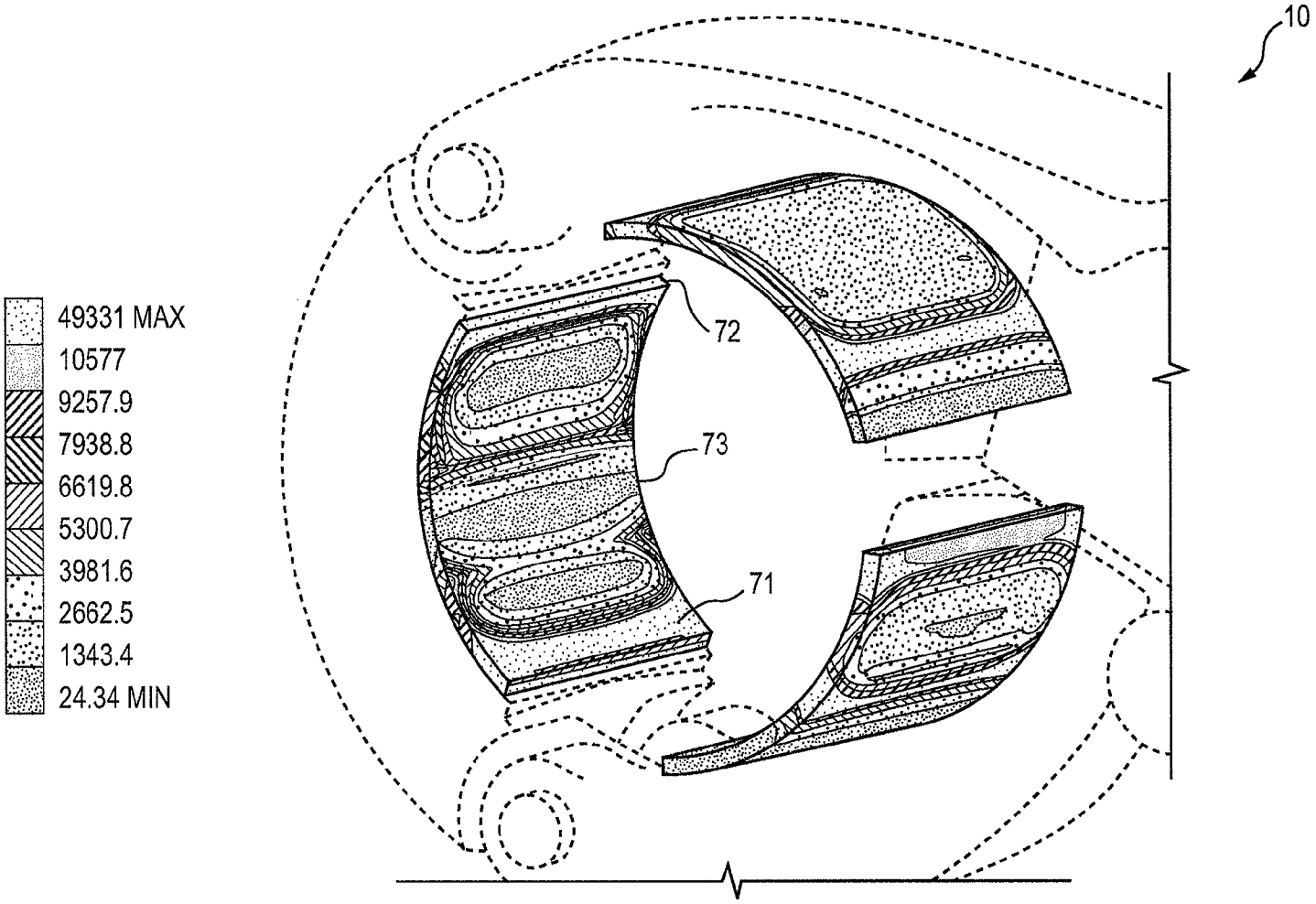
FIG. 9 illustrates distribution of contact pressures along regions of the friction material during application of greater loads.

FIG. 9 illustrates distribution of stresses in the friction material 70 as greater amounts of torque are applied from the wrench to the inner tube. Thus, the area of contact between a face of the friction material and the outer surface of the inner tube increases with increased loads. This is achieved at least in part by forming the faces of the friction material to exhibit an arcuate shape or profile which is defined by a radius that is less than the radius of the outer surface of the inner tube. In certain versions, the radius defining the arcuate profile of the friction material face is within a range of from 99.8% to 98% of the radius of the outer surface of the inner tube. The feature of increasing area of contact between the friction material face and the inner tube as load increases, is also achieved at least in part by use of a compressible friction material as described herein. As previously noted, in certain versions of the present subject matter, the friction material is selected so as to exhibit an elastic modulus value so that the material is compressed during use of the wrench. Materials having an elastic modulus value within a range of from 15 ksi to 1,500 ksi are particularly useful in this regard. These elastic moduli values of the friction materials are much less than that of steel which is a typical material of inner tubes or other cylindrical members. Thus, during use of the wrench and application of loads to the friction material, the friction material conforms to the shape and/or contour of the inner tube or other cylindrical member.

Figure 10:
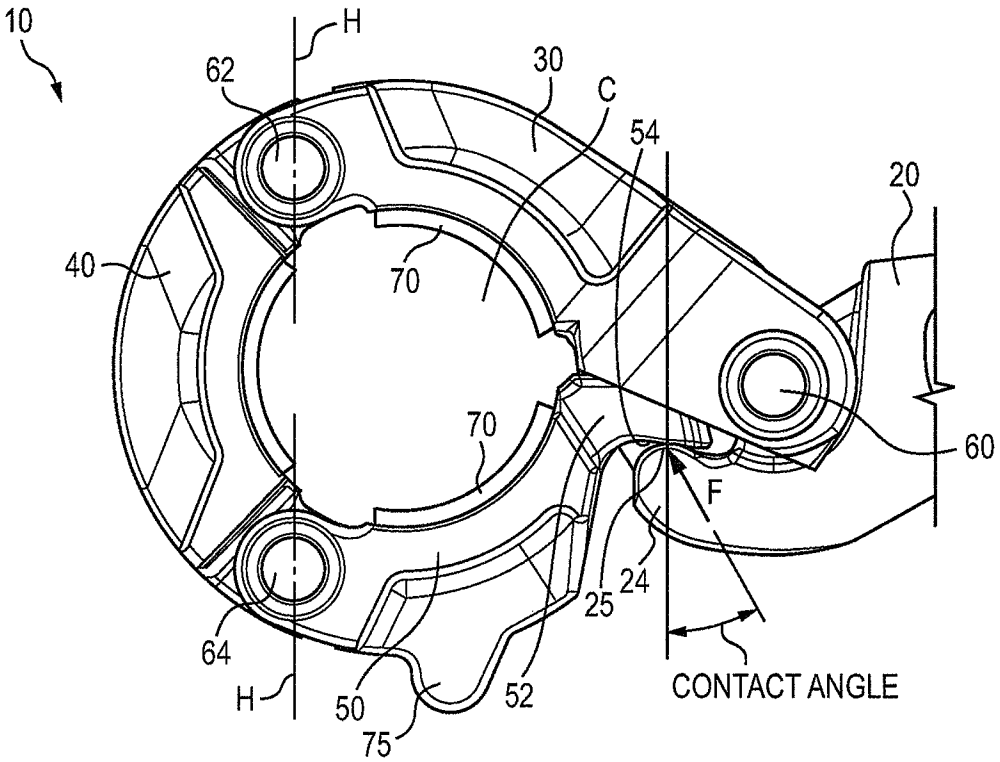
FIG. 10 illustrates an engagement feature between certain components of the wrenches of the present subject matter.

In yet another aspect, the present subject matter also provides particular engagement configurations and the use of certain contact angles between the handle and the distal end of the terminal or third jaw. For example, FIG. 10 illustrates the wrench 10 in a closed position in which contact occurs between a ridge 25 of the handle 20 and an engagement face 54 extending along the distal end 52 of the third jaw 50. As will be understood, upon positioning an inner tube within the gripping region C, slight variations in the diameter of the inner tube are accommodated by changing the contact location between the ridge 25 on the face 54. For example, larger diameters can be accommodated by the ridge 25 moving toward the pivot pin 60 during closing of the wrench. Smaller diameters can be accommodated by the ridge 25 moving away from the pivot pin during wrench closing until sufficient contact occurs between the friction material 70 and the inner tube. In certain versions of the wrenches of the present subject matter, the contact angle between the ridge 25 and the engagement face 54 is within a range of from 10° to 30°, and in still other versions, about 20°, as measured from a plane defined by the center axes of pivot pins 62 and 64. That plane is depicted in FIG. 10 as plane H.

More specifically, the engagement region depicted in the referenced figures and described herein includes an engagement ridge such as the ridge 25 provided on the handle and an engagement face such as face 54 on the terminal or third jaw. However, the present subject matter includes variant configurations. For example, the engagement face can be provided on the handle, and the engagement ridge can be provided on the handle terminal or third jaw.

Figure 11:
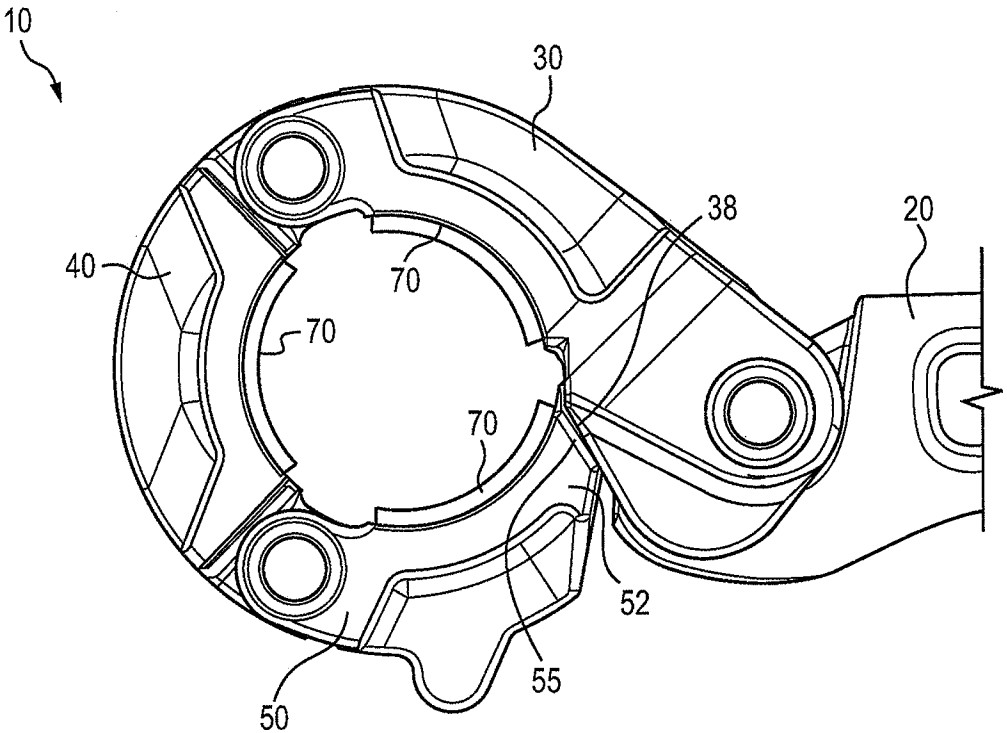
FIG. 11 illustrates a feature for preventing excessive levels of force by the wrenches of the present subject matter.

In yet another aspect of the present subject matter the wrenches can include provisions that limit application of excessive loads, i.e., compressive forces and/or torque, to an inner tube or other cylindrical member disposed in the gripping region when the wrench is in a closed position and a load is applied to the wrench. FIG. 11 illustrates an example of such provisions, referred to herein as a stop feature. FIG. 11 depicts the wrench 10 having the first jaw 30 defining a first stop face 38 and the third jaw 50 defining a second stop face 55. The stop faces 38 and 55 are located on their respective jaws such that they contact one another at a phase of wrench closing that correlates with application of a maximum allowable load to an inner tube or a design point considering a factor of safety, for example 75% of the yield of the inner tube. Due to contact between the stop faces 38 and 55, the span as measured between opposite regions of the friction material reaches a minimum distance. The stop feature may also be understood by considering the locations of the stop faces 38 and 55 relative to one another during use of the wrench. Prior to application of load, the first and second stop faces 38 and 55 are separated from one another. As load is applied to the wrench, friction material compressed, and torque is applied to an inner tube within the gripping region, the first jaw 30 and the third jaw 50 are drawn towards each other. As this occurs, the faces 38 and 55 are displaced toward one another. The faces 38 and 55 are located and positioned in the first and third jaws 30 and 50 such that upon application of a maximum allowable load, the faces 38 and 52 contact one another. Thus, gripping pressure and peak torque of the wrench can be limited. This feature is also described herein in conjunction with a system of a wrench and a cylindrical member having a known diameter.

The present subject matter also includes the use of provisions that enable the selective adjustment of the spacing or distance between the stop faces when the wrench is in a closed position. Thus, by changing the locations of the stop faces relative to one another, the closure span defined by the gripping region when the wrench is closed, can be selectively changed. As will be appreciated, changing the closure span increases or decreases the maximum loads placed upon cylindrical members in the gripping regions and being engaged therein.

Figure 12:
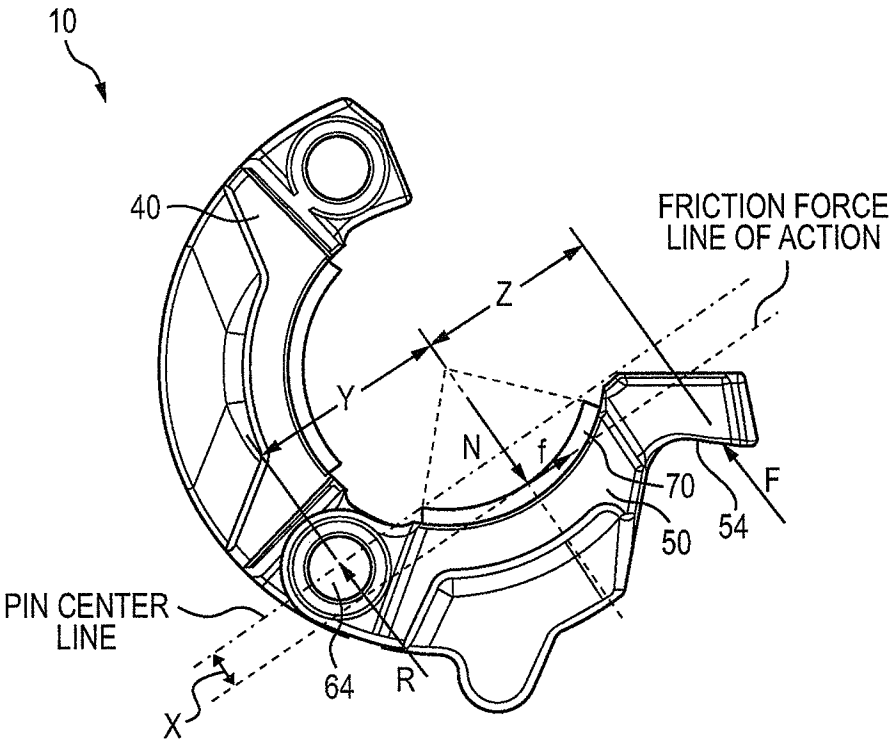
FIG. 12 illustrates a self-locking feature of the wrenches of the present subject matter.

FIG. 12 is a free body diagram illustrating a self-locking feature of certain wrenches in accordance with the present subject matter. That is, in this feature, selective location of a joint or pivot pin between the second and third jaws relative to the jaws can promote further engagement between the third jaw (and other jaws) and the inner tube. Similarly, this feature can also be embodied by selective location of a joint or pivot pin between the first and second jaws relative to those jaws which promotes engagement between the second jaw (and other jaws) and the inner tube. FIG. 12 illustrates the second and third jaws 40 and 50, and their pivot pin 64, during use of the wrench upon an inner tube (not shown) located in the gripping region. Upon application of a force to the wrench handle, the third jaw 50 is displaced by force "F" at the engagement face 54 to impart a force on the friction material 70. The resulting pressure on the friction material 70 is distributed across the surface of the friction material. However, the equivalent (or net) force "N" is directed radially into the center of the friction material. In coulomb friction, this force is known as the normal force. The equivalent (or net) friction force "f" is proportional to "N" and directed at a 90° angle with respect to the normal force to resist the relative motion between the friction material and the inner tube and thereby transmit torque to the inner tube or other cylindrical component. A reaction force "R" acts at the location of the pin 64. Referring further to FIG. 12, it can be seen that the line of action of the friction force "f" corresponds to a line transversely intersecting a plane bisecting the friction material. That is, the transverse line intersects the friction material bisecting plane at right angles.

The force "F" produces gripping pressure (i.e., produces the net force "N") at the friction material 70 by causing a counterclockwise moment of the third jaw 50 about the pin 64. Because the line of action of the friction force "f" is positioned outside the center line of the pin 64, the friction force also produces a counterclockwise moment about the pin 64. Thus, the friction force also contributes to the net force "N". Because the friction force contributes to "N" and is proportional to "N" it is self amplifying to some extent. As a result, the configuration can be said to be self-locking. These relationships can be expressed as equations (I)-(III) considering a statically balanced system:

$$\Sigma M_{pin}=0=F(Y+Z)+f(X)-N(Y) \quad \text{(I)}$$

$$N(Y)=F(Y+Z)+f(X) \quad \text{(II)}$$

$$N(Y)=F(Y+Z)+Np(X) \quad \text{(III)}$$

In equations (I)-(III); X, Y, and Z are distances between components or features and p is the coefficient of friction.

Thus, the self-locking feature of the present subject matter is achieved by locating pivot axis between two adjacent jaws such that a plane extending through the pivot axis and oriented parallel to a line of action of the friction force on either of the jaws, also extends across at least a portion of the gripping region.

In certain versions of the wrench, one or more covers or enclosures may be provided around the region of engagement between the engagement ridge of the handle and the engagement face of the terminal or third jaw. In certain applications it may be beneficial to provide sidewalls or other members that enclose or at least partially enclose the noted engagement region to prevent accumulation of dirt or debris in that region such as for example on the engagement ridge of the handle and/or the engagement face of the terminal jaw. Providing such sidewalls or other members to at least partially enclose the engagement region also limits access to the engagement region.

The present subject matter also provides systems of the wrenches and cylindrical members such as inner tubes having particular outer diameters. In certain embodiments, the wrenches are sized and/or configured for the inner tubes having particular outer diameters. A representative, non-limiting example of such a system is as follows. The system comprises a cylindrical member such as a core barrel inner tube having a known diameter and a maximum allowable load limit associated with the cylindrical member. The system also comprises a wrench including (i) a handle defining a first end and a second end, (ii) a plurality of hingedly connected jaw members, the plurality of jaw members including a primary jaw member pivotally attached to the first end of the handle and a terminal jaw member engageable with the handle, each of the plurality of jaw members defining an interior face, and (iii) a friction material disposed on at least one of the interior faces of the plurality of jaw members. The wrench is positionable between an open position and a closed position. The closed position results in the plurality of jaws defining an enclosed gripping region and a closure span extending between faces of friction material on opposing regions of the plurality of jaws. The wrench is configured such that the closure span is sized relative to the diameter of the cylindrical member so that upon positioning the cylindrical member within the gripping region and positioning the wrench to the closed position, the loads applied to the cylindrical member from the wrench are less than the maximum allowable load limit associated with the cylindrical member.

The wrench may also be configured so that a first stop face is provided on the primary jaw member and a second stop face is provided on the terminal jaw members. The first and second stop faces are located relative to one another such that upon positioning the wrench to the closed position, the first and second stop faces contact one another.

The present subject matter includes a wide range of variant assemblies, configurations, and components. For example, the present subject matter potentially includes versions of wrenches using chain assemblies having friction materials disposed thereon.

Many other benefits will no doubt become apparent from future application and development of this technology.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A wrench comprising:

a handle defining a first end and a second end opposite from the first end;

a first jaw having a proximal end, a distal end, the first jaw defining an interior face, the proximal end of the first jaw pivotally attached to the first end of the handle;

a second jaw having a proximal end, a distal end, the second jaw defining an interior face, the proximal end of the second jaw pivotally attached to the distal end of the first jaw at a first joint assembly;

a third jaw having a proximal end, a distal end, the third jaw defining an interior face, the proximal end of the third jaw pivotally attached to the distal end of the second jaw at a second joint assembly, the distal end of the third jaw being releasably engageable with the first end of the handle;

wherein the first, second, and third jaws are positionable between (i) a closed position in which the distal end of the third jaw is engaged with the first end of the handle and the interior faces of the first, second, and third jaws define an enclosed gripping region defining a closure span, and (ii) a fully opened position in which the distal end of the third jaw is spaced from the first end of the handle to thereby enable radial access to the gripping region;

wherein when the wrench is in a fully opened position at least one of the following occurs:

(a) a maximum distance between the distal end of the third jaw and the first end of the handle is less than 150% of the closure span;

(b) a maximum distance between opposite interior faces of the first jaw and the second jaw is less than 150% of the closure span; and (c) a maximum distance between opposite interior faces of the second jaw and the third jaw is less than 150% of the closure span.

2. The wrench of claim 1 wherein the distal end of the first jaw defines a first aperture, the proximal end of the second jaw defines a second aperture, and the first joint assembly includes a pin extending through the first and second apertures aligned with one another.

3. The wrench of claim 2 wherein the first joint assembly further includes a shoulder projecting from one of the first jaw and the second jaw which upon angular extension of the first and second jaw, contacts a stop face defined on the other of the first and second jaw, to thereby limit any further angular extension of the first and second jaws.

4. The wrench of claim 1 wherein the distal end of the second jaw defines a first aperture, the proximal end of the third jaw defines a second aperture, and the second joint assembly includes a pin extending through the first and second apertures aligned with one another.

5. The wrench of claim 4 wherein the second joint assembly further includes a shoulder projecting from one of the second jaw and the third jaw which upon angular extension of the second and third jaws, contacts a stop face defined on the other of the second and third jaws, to thereby limit any further angular extension of the second and third jaws.

6. The wrench of claim 1 wherein the first joint assembly includes provisions associated with at least one of the first jaw and the second jaw which limit angular displacement between the first and the second jaws to less than 180 degrees.

7. The wrench of claim 1 wherein the second joint assembly includes provisions associated with at least one of the second jaw and the third jaw which limit angular displacement between the second and the third jaws to less than 180 degrees.

8. The wrench of claim 1 further comprising:

a friction material disposed on at least one of the interior faces of the first, second, and third jaws.

9. The wrench of claim 8 wherein the friction material is free of asbestos.

10. The wrench of claim 8 wherein the friction material is releasably attached to at least one of the interior faces of the first, second, and third jaws.

11. The wrench of claim 8 wherein the friction material defines a face that exhibits an arcuate contour defined by a friction face radius, the friction face radius being less than one-half of the closure span.

12. The wrench of claim 11 wherein the friction face radius is within a range of 99.8% to 98% of one-half of the closure span.

13. The wrench of claim 8 wherein the friction material defines a face having a plurality of recesses extending along at least a portion of the face.

14. The wrench of claim 13 wherein the plurality of recesses have a size and configuration sufficient to receive liquid or debris.

15. The wrench of claim 8 wherein the second jaw and the third jaw pivot relative to one another about a pivot axis, wherein the pivot axis is located such that a plane extending through the pivot axis and oriented parallel to a line transversely intersecting a plane bisecting the friction material, also extends across at least a portion of the gripping region.

16. The wrench of claim 8 wherein the first jaw and the second jaw pivot relative to one another about a pivot axis, wherein the pivot axis is located such that a plane extending through the pivot axis and oriented parallel to a line transversely intersecting a plane bisecting the friction material, also extends across at least a portion of the gripping region.

17. The wrench of claim 1 further comprising:

a biasing member disposed between the first jaw and the handle and configured to bias the first jaw toward the closed position.

18. The wrench of claim 1 further comprising:

an outwardly extending finger hook disposed on at least one of the first jaw, the second jaw portion, and the third jaw.

19. The wrench of claim 1 wherein the first jaw defines a first stop face and the third jaw defines a second stop face, the first and second stop faces configured and spaced from one another such that when the wrench is in a closed position the first and second stop faces contact one another.

20. The wrench of claim 1 wherein one of the first jaw and the handle define an engagement face and the other of the first jaw and the handle define an engagement ridge, the engagement face and the engagement ridge configured to contact each other upon positioning the wrench to the closed position.

21. The wrench of claim 20 wherein the engagement face and the engagement ridge contact one another at a contact angle within a range of from 10° to 30° relative to a plane defined by a pin of the first joint and a pin of the second joint.

22. The wrench of claim 21 wherein the contact angle is 20°.

23. A wrench comprising:

a handle defining a first end and a second end;

a plurality of hingedly connected jaw members, the plurality of jaw members including a primary jaw member pivotally attached to the first end of the handle and a terminal jaw member engageable with the handle, each of the plurality of jaw members defining an interior face;

a friction material disposed on at least one of the interior faces of the plurality of jaw members;

provisions associated with at least two adjacent jaws which limit angular displacement between the two adjacent jaws to less than 180 degrees.

24. The wrench of claim 23 wherein the friction material is free of asbestos.

25. The wrench of claim 23 wherein the friction material defines a face that exhibits an arcuate contour defined by a friction face radius, the friction face radius being less than one-half of a closure span, the closure span being a maximum distance between opposing faces of the friction material when the wrench is in a closed position.

26. The wrench of claim 25 wherein the friction face radius is within a range of 99.8% to 98% of one-half the closure span.

27. The wrench of claim 23 wherein the friction material defines a face having a plurality of recesses extending along at least a portion of the face.

28. The wrench of claim 27 wherein the plurality of recesses have a size and configuration sufficient to receive liquid or debris.

29. The wrench of claim 23 further comprising:

a biasing member disposed between the primary jaw member and the handle and configured to bias the primary jaw member toward a closed portion.

30. The wrench of claim 23 further comprising:

an outwardly extending finger hook disposed on at least one of the jaw members.

31. The wrench of claim 23 wherein the primary jaw defines a first stop face and the terminal jaw defines a second stop face, the first and second stop faces configured and spaced from one another such that when the wrench is in a closed position, the first and second stop faces contact one another.

32. The wrench of claim 23 wherein one of the primary jaw and the handle defines an engagement face and the other of the primary jaw and the handle defines an engagement ridge, the engagement face and the engagement ridge configured to contact each other upon positioning the wrench to a closed position.

33. The wrench of claim 32 wherein the engagement face and the engagement ridge contact one another at a contact angle within a range of from 10° to 30°.

34. The wrench of claim 33 wherein the contact angle is 20°.

35. The wrench of claim 23 wherein the plurality of jaw members total three jaws and include a second jaw member disposed between the primary jaw member and the terminal jaw member.

36. The wrench of claim 35 wherein the plurality of jaw members are positionable between (i) a closed position in which a distal end of the terminal jaw is engaged with the first end of the handle and the interior faces of the jaws define an enclosed gripping region that defines a closure span, and (ii) a fully opened position in which a distal end of the terminal jaw is spaced from the first end of the handle to thereby enable radial access to the gripping region.

37. The wrench of claim 36 wherein the wrench includes a limited articulation provision whereby when the wrench is in a fully opened position at least one of the following occurs:

(a) a maximum distance between the distal end of the terminal jaw and the first end of the handle is less than 300% of the closure span;

(b) a maximum distance between opposite interior faces of the primary jaw and the second jaw is less than 300% of the closure span; and (c) a maximum distance between opposite interior faces of the second jaw and the terminal jaw is less than 300% of the closure span.

38. The wrench of claim 23 wherein the plurality of jaw members include two adjacent jaws, the two adjacent jaws pivot relative to one another about a pivot axis, wherein the pivot axis is located such that a plane extending through the pivot axis and oriented parallel to a line transversely intersecting a plane bisecting the friction material, also extends across at least a portion of a gripping region defined by the plurality of jaw members.

39. A system comprising:

a cylindrical member having a diameter and a maximum allowable load limit associated with the cylindrical member; and a wrench including (i) a handle defining a first end and a second end, (ii) a plurality of hingedly connected jaw members, the plurality of jaw members including a primary jaw member pivotally attached to the first end of the handle and a terminal jaw member engageable with the handle, each of the plurality of jaw members defining an interior face, (iii) a friction material disposed on at least one of the interior faces of the plurality of jaw members, and (iv) biasing members provided between adjacent jaw members, wherein the wrench is positionable between a fully opened position and a closed position, the closed position resulting in the plurality of jaws defining an enclosed gripping region and a closure span extending between faces of friction material on opposing regions of the plurality of jaws, the wrench configured such that the closure span is sized relative to the diameter of the cylindrical member so that upon positioning the cylindrical member within the gripping region and positioning the wrench to the closed position, the loads applied to the cylindrical member from the wrench are less than the maximum allowable load limit associated with the cylindrical member.

40. The system of claim 39 wherein the wrench is configured by a first stop face provided on the primary jaw member and a second stop face provided on the terminal jaw member, the first and second stop faces located relative to one another such that upon positioning the wrench to the closed position, the first and second stop faces contact one another.

41. The system of claim 39 wherein the friction material is free of asbestos.

42. The system of claim 39 wherein the friction material defines a face having a plurality of recesses extending along at least a portion of the face.

43. The system of claim 42 wherein the plurality of recesses have a size and configuration sufficient to receive liquid or debris.

44. The system of claim 39 wherein the friction material is releasably attached to at least one of the interior faces of the first, second, and third jaw portions.

45. The system of claim 39 wherein the friction material defines a face that exhibits an arcuate contour defined by a friction face radius, the friction face radius being less than one-half of the closure span.

46. The system of claim 45 wherein the friction face radius is within a range of 99.8% to 98% of one-half of the closure span.

47. The system of claim 39 further comprising:

a biasing member disposed between the primary jaw member and the handle and configured to bias the primary jaw member toward the closed position.

48. The system of claim 39 further comprising:

an outwardly extending finger hook disposed on at least one of the primary jaw member and the terminal jaw member.

49. The system of claim 39 wherein the wrench includes a limited articulation provision whereby when the wrench is in a fully opened position at least one of the following occurs:

(a) a maximum distance between the distal end of the terminal jaw and the first end of the handle is less than 300% of the closure span;

(b) a maximum distance between opposite interior faces of the primary jaw and the second jaw is less than 300% of the closure span; and (c) a maximum distance between opposite interior faces of the second jaw and the terminal jaw is less than 300% of the closure span.

50. The system of claim 39 wherein the plurality of jaw members include two adjacent jaws, the two adjacent jaws pivot relative to one another about a pivot axis, wherein the pivot axis is located such that a plane extending through the pivot axis and oriented parallel to a line transversely intersecting a plane bisecting the friction material, also extends across at least a portion of the gripping region defined by the plurality of jaw members.

51. The system of claim 39 wherein one of (i) a jaw of the plurality of jaws and (ii) the handle define an engagement face and the other of (i) the jaw of the plurality of jaws and (ii) the handle define an engagement ridge, the engagement face and the engagement ridge configured to contact each other upon positioning the wrench to the closed position.

52. The system of claim 51 wherein the engagement face and the engagement ridge contact one another at a contact angle within a range of from 10° to 30° relative to a plane defined by a pin of a first joint between a first pair of adjacent jaws and a pin of a second joint between a second pair of adjacent jaws.

53. The system of claim 52 wherein the contact angle is 20°.

54. A wrench comprising:

a handle defining a first end and a second end opposite from the first end;

a first jaw having a proximal end, a distal end, the first jaw defining an interior face, the proximal end of the first jaw pivotally attached to the first end of the handle;

a second jaw having a proximal end, a distal end, the second jaw defining an interior face, the proximal end of the second jaw pivotally attached to the distal end of the first jaw at a first joint assembly;

a third jaw having a proximal end, a distal end, the third jaw defining an interior face, the proximal end of the third jaw pivotally attached to the distal end of the second jaw at a second joint assembly, the distal end of the third jaw being releasably engageable with the first end of the handle;

wherein the first, second, and third jaws are positionable between (i) a closed position in which the distal end of the third jaw is engaged with the first end of the handle and the interior faces of the first, second, and third jaws define an enclosed gripping region defining a closure span, and (ii) a fully opened position in which the distal end of the third jaw is spaced from the first end of the handle to thereby enable radial access to the gripping region;

wherein the distal end of the first jaw defines a first aperture, the proximal end of the second jaw defines a second aperture, and the first joint assembly includes a pin extending through the first and second apertures aligned with one another, and the first joint assembly further includes a shoulder projecting from one of the first jaw and the second jaw which upon angular extension of the first and second jaw, contacts a stop face defined on the other of the first and second jaw, to thereby limit any further angular extension of the first and second jaws.

55. The wrench of claim 54 wherein the distal end of the second jaw defines a first aperture, the proximal end of the third jaw defines a second aperture, and the second joint assembly includes a pin extending through the first and second apertures aligned with one another.

56. The wrench of claim 55 wherein the second joint assembly further includes a shoulder projecting from one of the second jaw and the third jaw which upon angular extension of the second and third jaws, contacts a stop face defined on the other of the second and third jaws, to thereby limit any further angular extension of the second and third jaws.

57. The wrench of claim 54 wherein the first joint assembly includes provisions associated with at least one of the first jaw and the second jaw which limit angular displacement between the first and the second jaws to less than 180 degrees.

58. The wrench of claim 54 wherein the second joint assembly includes provisions associated with at least one of the second jaw and the third jaw which limit angular displacement between the second and the third jaws to less than 180 degrees.

59. The wrench of claim 54 further comprising:

a friction material disposed on at least one of the interior faces of the first, second, and third jaws.

60. The wrench of claim 59 wherein the friction material is free of asbestos.

61. The wrench of claim 59 wherein the friction material is releasably attached to at least one of the interior faces of the first, second, and third jaws.

62. The wrench of claim 59 wherein the friction material defines a face that exhibits an arcuate contour defined by a friction face radius, the friction face radius being less than one-half of the closure span.

63. The wrench of claim 62 wherein the friction face radius is within a range of 99.8% to 98% of one-half of the closure span.

64. The wrench of claim 59 wherein the friction material defines a face having a plurality of recesses extending along at least a portion of the face.

65. The wrench of claim 64 wherein the plurality of recesses have a size and configuration sufficient to receive liquid or debris.

66. The wrench of claim 59 wherein the second jaw and the third jaw pivot relative to one another about a pivot axis, wherein the pivot axis is located such that a plane extending through the pivot axis and oriented parallel to a line transversely intersecting a plane bisecting the friction material, also extends across at least a portion of the gripping region.

67. The wrench of claim 59 wherein the first jaw and the second jaw pivot relative to one another about a pivot axis, wherein the pivot axis is located such that a plane extending through the pivot axis and oriented parallel to a line transversely intersecting a plane bisecting the friction material, also extends across at least a portion of the gripping region.

68. The wrench of claim 54 further comprising:

a biasing member disposed between the first jaw and the handle and configured to bias the first jaw toward the closed position.

69. The wrench of claim 54 further comprising:

an outwardly extending finger hook disposed on at least one of the first jaw, the second jaw portion, and the third jaw.

70. The wrench of claim 54 wherein the first jaw defines a first stop face and the third jaw defines a second stop face, the first and second stop faces configured and spaced from one another such that when the wrench is in a closed position the first and second stop faces contact one another.

71. The wrench of claim 54 wherein one of the first jaw and the handle define an engagement face and the other of the first jaw and the handle define an engagement ridge, the engagement face and the engagement ridge configured to contact each other upon positioning the wrench to the closed position.

72. The wrench of claim 71 wherein the engagement face and the engagement ridge contact one another at a contact angle within a range of from 10° to 30° relative to a plane defined by a pin of the first joint and a pin of the second joint.

73. The wrench of claim 72 wherein the contact angle is 20°.

* * * * *